United States Patent [19]

Birch et al.

[11] 4,403,952

[45] Sep. 13, 1983

[54] APPARATUS FOR DRIVING A ROTARY DRUM, SUCH AS A ROTARY KILN

[75] Inventors: Per Birch, Copenhagen; Christian Marcussen, Valby, both of Denmark

[73] Assignee: F. L. Smidth & Co., Cresskill, N.J.

[21] Appl. No.: 317,466

[22] Filed: Nov. 2, 1981

[30] Foreign Application Priority Data

Nov. 4, 1980 [DK] Denmark ..... 4668/80

[51] Int. Cl.[3] ..... F27B 7/00

[52] U.S. Cl. ..... 432/103; 60/325; 60/431

[58] Field of Search ..... 432/103; 60/325, 431

[56] References Cited

U.S. PATENT DOCUMENTS 3,033,057 5/1962 Gray ..... 432/103
3,785,221 1/1974 Fifield ..... 417/223
4,007,591 2/1977 Hinchmann et al. ..... 60/325
4,274,257 6/1981 Koch, Jr. et al. ..... 417/222

FOREIGN PATENT DOCUMENTS 2446941 of 0000 Fed. Rep. of Germany .

*Primary Examiner*—John J. Camby
*Attorney, Agent, or Firm*—Pennie & Edmonds

[57] ABSTRACT

A substantially horizontal rotating drum mounted on roller pairs which drum is driven via some of the rollers, drive rollers, by means of a hydrostatic motor on each drive roller. In order to avoid problems, e.g., stoppage if the contact between the drum and one or more drive rollers ceases, each hydrostatic motor is part of a separate power circuit further comprising a hydrostatic pump and a squirrel-cage motor constantly ensuring essentially the same peripheral speed for drum and drive roller irrespective of the torque size.

8 Claims, 2 Drawing Figures

APPARATUS FOR DRIVING A ROTARY DRUM, SUCH AS A ROTARY KILN

TECHNICAL FIELD

This invention relates to an apparatus for driving a drum and more particularly to a drive for a rotary drum.

BACKGROUND ART

Drives for a rotary drum rotating about a horizontal or vaguely oblique axis, and mounted on more than two roller pairs separated by an axial distance relative to each other are known, e.g., from the specification of German patent application No. 2,446,941. Typically at least two individual rollers of the roller pairs are each driven via a hydrostatic motor. However, the drum according to the aforementioned German patent application is only mounted on two roller pairs. Here the rollers roll, as is normally the case, against live rings interspaced on the drum. The torque is transferred from the driven rollers to the live rings by friction.

However, it is a general feature that long drums, particularly rotary kilns, are mounted on more than two roller pairs. As opposed to mounting on two roller pairs, it may then occur that the drum is not in constant contact with all the rollers. This can happen in case of rotary kilns which may distort due to uneven heating of the kiln shell.

If the contact between a drive roller and the drum thus ceases, i.e., the torque with respect to that roller drops to zero, the roller will, as is normal, if it is part of a pressure oil system for all the remaining drive rollers, consume the entire amount of oil, and the drum will come to a standstill, whereas the relieved roller rotates correspondingly faster.

We have invented a drive for a drum which avoids the aforementioned disadvantages of the prior art and makes possible the use of hydrostatically driven rollers also for a drum mounted on more than two roller pairs.

DISCLOSURE OF THE INVENTION

The present invention relates to an apparatus for driving a drum rotating about an axis and mounted on more than two roller pairs of which at least two individual rollers are each driven via a hydrostatic motor, characterized in that the torque distribution for the drum is provided by the hydrostatic motors distributed in power circuits each including a hydrostatic motor, a variable displacement hydrostatic pump and a pump drive motor, the torque distribution being set at predetermined levels such that the slip in any individual power circuit lies within predetermined limits.

According to the invention the object is achieved by setting the torque distribution for the drum from the hydrostatic motors distributed in power circuits each comprising a hydrostatic motor, a variable displacement hydrostatic pump and a pump drive motor at such values that the slip in the individual power circuits lies within permissible limits, and by furthermore providing each power circuit with controls known per se adapted for setting stops, minimum and maximum speed as well as ramp time between these speeds corresponding to the torque distribution desired at all times.

The torque can in a simple way be determined by measuring the pressure drop over the hydrostatic motor.

By the slip in a power circuit in a given operational condition is meant the relative difference between the theoretical oil consumption of the hydrostatic motor and the theoretical oil production of the hydrostatic pump aggregate. The slip occurs partly due to leakage in pump and oil motor, and partly due to slip in pump drive motor.

By a dirve according to the invention it is possible, owing to the separate control of each individual drive roller, to maintain the operation of the drum also if the contact between one or more rollers and the drum ceases for some time. At the same time it is achieved that a drive roller while being out of contact with the drum only increases its speed by the value made possible by the slip in the power circuit, and consequently the difference between the peripheral speed of the drum and that of the roller is minimal also without contact.

Furthermore, the system is self-compensating for the variable gearing between the various drive rollers and the drum, deriving e.g. from temperature difference between the rollers and/or the live rings on the drum.

BRIEF DESCRIPTION OF THE DRAWINGS

The present invention is explained in greater detail hereinbelow with reference to the accompanying drawings wherein.

BEST MODE FOR CARRYING OUT THE INVENTION

Figure 1:
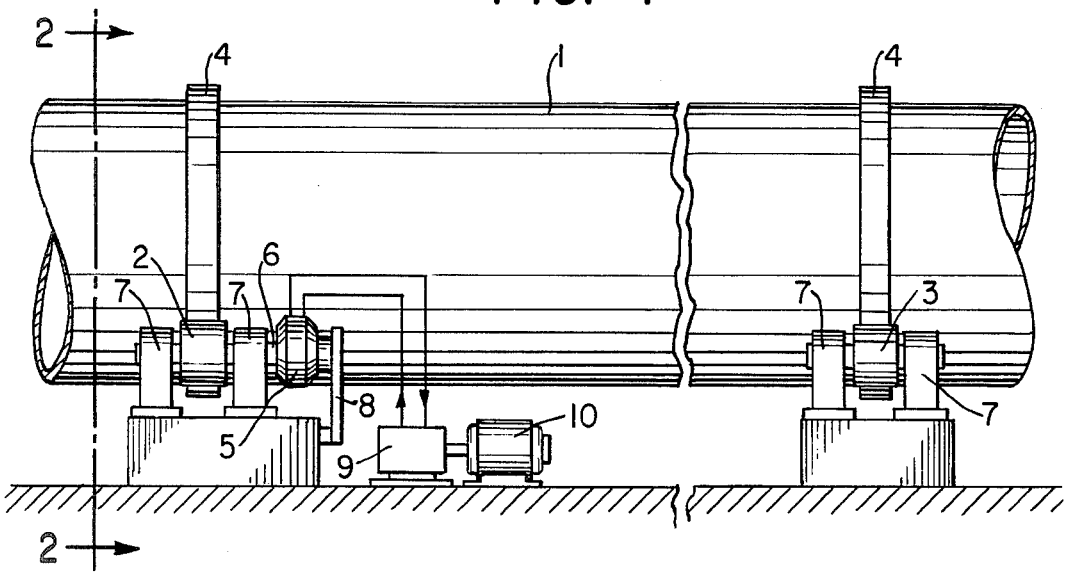
FIG. 1 is a schematic side elevational view of a portion of a drum on rollers and a drive according to the present invention for rotating the drum.
Figure 2:
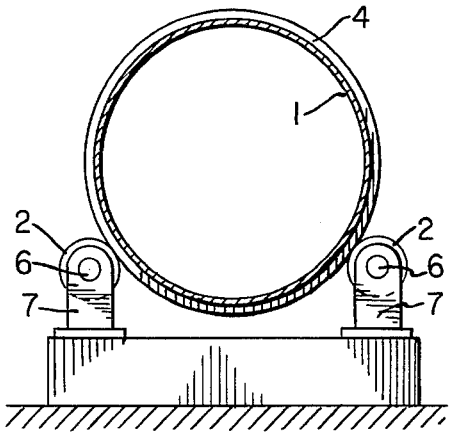
FIG. 2 is a cross-sectional view taken along the line 2—2 of FIG. 1.

Referring to the drawings, a drum 1 illustrated in FIG. 1 is pivotally mounted on roller pairs distributed in a manner known to those skilled in the art and separated from each other along the longitudinal direction of the drum. FIG. 1 illustrates only two roller pairs 2,2 and 3,3 running against live rings 4 mounted on the drum 1.

The drum 1 is driven via the drive rollers 2 by like hydrostatic motors 5, of which only one is shown for convenience of illustration, mounted at one end of the shaft 6 of the drive roller, which end projects from one of the bearing houses of the roller.

The motor 5 has a stop, indicated by 8, to counteract rotation of the motor housing.

Each hydrostatic motor 5 is part of a separate power circuit comprising a variable displacement hydrostatic pump 9 and, e.g., a squirrel-cage motor 10.

The power circuit has controls (not shown but known to those skilled in the art) which are adapted for setting stop, minimum and maximum speed as well as ramp time between these speeds, corresponding to the torque distribution desired at all times.

If the torque for the drive roller is reduced, the power circuit will try to increase the speed within th slip of the circuit and vice versa.

As it is a well-known fact that a power circuit of the kind in question has a slip of the size 20—10 percent at a torque variation of ±50 percent it suffices to establish a system by which the setting of the power circuit should merely be ensured within, e.g., 5 percent.

According to the present invention, constant control and monitoring of the power circuit can be avoided.

We claim:

1. Apparatus for driving a rotary drum rotating about an axis comprising more than two spaced apart live rings adapted for being positioned about the drum, more than two roller pairs on which the drum is mounted, each pair of rollers being positioned for engagement with a respective live ring, at least two individual power circuits each including a hydrostatic motor, a variable displacement hydrostatic pump and a pump drive motor, at least two individual rollers of said roller pairs each being driven individually by its own respective hydrostatic motor, characterized in that the torque distribution for the drum is provided by the hydrostatic motors distributed in the respective power circuits, the torque distribution being set at predetermined levels such that the slip in any individual power circuit lies within predetermined limits.

2. Apparatus for driving a rotary kiln rotating about a generally horizontal axis, comprising more than two spaced apart live rings adapted for being positioned about the drum, more than two spaced apart roller pairs on which the drum is mounted, each pair of rollers being positioned for engagement with a respective live ring, at least two individual power circuits each including a hydrostatic motor, a variable displacement hydrostatic pump and a pump drive motor, at least two individual rollers of the roller pairs are each driven individually by its own respective hydrostatic motor, characterized in that the torque distribution for the rotary kiln is provided by hydrostatic motors distributed in the respective power circuits, said torque distribution being set at predetermined levels such that the slip in any individual power circuit lies within predetermined limits, each power circuit further comprising control means adapted for setting stop, minimum and maximum speed as well as ramp time between these speeds in accordance with said torque distribution.

3. The apparatus according to claim 2 wherein the power circuits are hydraulically independent of each other.

4. The apparatus according to claim 2 wherein at least one power circuit comprises several hydrostatic motors.

5. The apparatus according to claim 2 wherein at least one power circuit comprises several hydrostatic pumps.

6. The apparatus according to any of claims 2, 3, 4 and 5 wherein the power circuits differ as to torque outputs.

7. Apparatus for driving a drum, preferably a rotary kiln, rotating about a horizontal or vaguely oblique axis, comprising more than two live rings adapted for being positioned about the drum, more than two roller pairs separated by an axial distance relative to each other and on which the drum is mounted, each pair of rollers being positioned for engagement with a respective live ring, at least two individual power circuits each including a hydrostatic motor, a variable displacement hydrostatic pump and a pump drive motor, of which roller pairs at least two individual rollers are each driven individually by its own hydrostatic motor, characterized in that the torque distribution for the drum from the hydrostatic motors distributed in the respective power circuts is set at such values that the slip in the individual power circuit lies within permissible limits and that each power circuit furthermore comprises controls known per se adapted for setting stop, minimum and maximum speed as well as ramp time between these speeds corresponding to the torque distribution desired at all times.

8. A rotary kiln comprising a rotary drum rotating about an axis, more than two spaced apart live rings adapted for being positioned about the drum, more than two roller pairs on which the drum is mounted, each pair of rollers being positioned for engagement with a respective live ring, at least two individual power circuits each including a hydrostatic motor, a variable displacement hydrostatic pump and a pump drive motor, at least two individual rollers of said roller pairs each being driven individually by its own respective hydrostatic motor, characterized in that the torque distribution for the drum is provided by the hydrostatic motors distributed in the respective power circuits, the torque distribution being set at predetermined levels such that the slip in any individual power circuit lies within predetermined limits.

* * * * *